US007229954B1

(12) United States Patent
Williams

(10) Patent No.: US 7,229,954 B1
(45) Date of Patent: Jun. 12, 2007

(54) CARPET CLEANING COMPOSITION WITH CITRUS

(75) Inventor: Jesse J. Williams, Hudsonville, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 154 days.

(21) Appl. No.: 10/707,764

(22) Filed: Jan. 9, 2004

Related U.S. Application Data

(60) Provisional application No. 60/319,851, filed on Jan. 10, 2003.

(51) Int. Cl.
*C11D 3/43* (2006.01)
*C11D 3/50* (2006.01)
*C11D 1/72* (2006.01)

(52) U.S. Cl. ..... 510/278; 510/289; 510/299; 510/400; 510/413; 510/421; 510/434; 510/463; 510/476; 510/477; 510/101

(58) Field of Classification Search ..... 510/278, 510/289, 299, 400, 413, 421, 434, 463, 476, 510/477
See application file for complete search history.

(56) References Cited

U.S. PATENT DOCUMENTS 4,304,675 A 12/1981 Corey et al.
4,455,250 A * 6/1984 Frazier ..... 510/106
4,477,288 A * 10/1984 Kazmierczak et al. ..... 134/19
4,511,488 A 4/1985 Matta
4,566,980 A 1/1986 Smith
4,620,937 A 11/1986 Dellutri
4,790,951 A * 12/1988 Frieser et al. ..... 510/365
4,873,000 A 10/1989 Weller
5,462,690 A * 10/1995 Rhinesmith ..... 510/417
5,534,167 A * 7/1996 Billman ..... 510/280
5,573,710 A 11/1996 McDonell
5,580,495 A * 12/1996 Young ..... 510/340
5,602,090 A * 2/1997 Melikyan et al. ..... 510/372
5,610,189 A * 3/1997 Whiteley ..... 514/557
5,643,861 A * 7/1997 de Guertechin et al. .... 510/365
5,837,665 A * 11/1998 Young ..... 510/278
5,895,504 A 4/1999 Sramek et al.
5,928,384 A 7/1999 Scialla et al.
5,942,482 A * 8/1999 Zocchi et al. ..... 510/280
5,955,413 A 9/1999 Campagna et al.
5,962,391 A * 10/1999 Oldenhove ..... 510/369
6,008,175 A * 12/1999 Scialla et al. ..... 510/278
6,048,368 A * 4/2000 Tcheou et al. ..... 8/137
6,130,253 A * 10/2000 Franklin et al. ..... 514/690
RE36,982 E 12/2000 Melikyan et al.
6,316,399 B1 * 11/2001 Melikyan et al. ..... 510/372
6,326,344 B1 * 12/2001 Levitt ..... 510/278
6,451,065 B2 9/2002 Trinh et al.
6,624,135 B2 * 9/2003 Takano ..... 510/438
6,767,874 B2 * 7/2004 Gonzalez ..... 510/109
6,767,881 B1 * 7/2004 Griese et al. ..... 510/421
6,833,342 B2 * 12/2004 Woo et al. ..... 510/280

* cited by examiner

*Primary Examiner*—Charles Boyer
(74) *Attorney, Agent, or Firm*—McGarry Bair PC

(57) ABSTRACT

A carpet cleaning composition comprises a terpene hydrocarbon solvent that also functions as a fragrance, one or more surfactants, an anti-soil component, an anti-stain component, water, and, optionally, an anti-foam agent and a pH adjusting agent. In the preferred embodiment, the terpene hydrocarbon solvent is d-limonene, an organic, low volatility solvent produced from citrus oil extract. The pH adjusting agent maintains a pH in the carpet cleaning composition between 8.5 and 9.5 and preferably about 9.0.

40 Claims, No Drawings

CARPET CLEANING COMPOSITION WITH CITRUS

CROSS REFERENCE TO RELATED APPLICATIONS

This application claims the benefit of U.S. Provisional Application Ser. No. 60/319,851, filed Jan. 10, 2003, entitled "Carpet Cleaning Composition with Citrus."

BACKGROUND OF INVENTION

1. Field of the Invention

The invention relates to carpet and fabric cleaning compositions, and more specifically to a carpet cleaning composition that includes a combination organic solvent and fragrance. In one of its aspects, the invention relates to a carpet cleaning solution that includes an organic, citrus based, low volatility cleaning solvent.

2. Description of the Related Art

Conventional carpet and upholstery cleaning compositions typically contain anionic and/or nonionic surfactants, an anti-soiling agent such as polymerized styrene/maleic anhydride, a solvent such as glycol ether, and a fragrance to impart a pleasant scent. Known carpet cleaning compositions are disclosed in the Campagna et al. U.S. Pat. No. 5,955,413 and Scialla et al. U.S. Pat. No. 5,928,384, both of which are incorporated herein by reference. Examples of commercially available cleaning solutions include: BISSELL Fiber Cleansing Formula, Hoover Steam Vac carpet/upholstery detergent, Dirt Devil carpet & rug shampoo, Rug Doctor Steam Cleaner, and Full Release Professional Carpet Cleaner by Oreck. The BISSELL Fiber Cleansing Formula comprises water; an anti-stain agent; an acrylate copolymer that functions as an anti-soil agent and a pH adjusting agent; an alkyl naphthalene sodium sulfonate, which is an anionic surfactant; a blend of two alkoxylated lineal alcohols, which is a nonionic surfactant; a trace of an anti-foam agent; and a fragrance.

Carpet cleaning compositions should be stable and essentially free of volatile solvents, yet have a pleasant fragrance the remains with the carpet after cleaning. The fragrance qualities of liquid commercial products are greatly dependent on the plethora of volatile and semi-volatile organic compounds contained therein. However, volatile organic compounds are known to deplete naturally occurring ozone in the upper atmosphere and are thus desirably avoided. Also, a small segment of the population is hypersensitive to even the slightest exposure to volatile organic compounds.

A fragrance having low volatility is d-limonene, commonly known as citrus oil. d-Limonene is also an effective solvent for cleaning products. U.S. Reissue Pat. No. 36,982 to Melikyan et al. discloses a cleaning composition for a variety of industrial and household applications, including cleaning and removing spots from carpets, and comprising d-limonene and hydrogen peroxide. The background section of Melikyan "982 states that many other patents disclose the use of d-limonene, which provides a pleasant citrus-like aroma, as well as cleaning properties. Other cleaning compositions containing d-limonene are disclosed in U.S. Pat. No. 4,511,488 to Matta and U.S. Pat. No. 4,620,937 to Dellutri. The Matta '488 composition is said to be suitable for hard and/or flexible substrates and contains a minimum of 7.8 wt. % d-limonene. The concentration of d-limonene in the Dellutri "937 composition varies according to its purpose, and the preferred d-limonene concentration is 60 vol. %. The Dellutri "937 composition is said to be useful for cleaning carpets.

U.S. Pat. No. 6,326,344 to Levitt discloses a carpet cleaning composition that contains little or no surfactant for good emulsification and, thus, leaves no tacky residue upon drying. The composition comprises about 50–98 wt. % water, about 0.05–2 wt. % acid copolymer emulsifier, about 0–1 wt. % of at least one surfactant, and about 1–50 wt. % of at least one solvent. d-Limonene is listed as one of the many preferable water-insoluble solvents. Additionally, the composition may contain a buffer to maintain the pH of the composition within the range of about 4 to 10.

U.S. Pat. No. 6,048,368 to Tcheou et al. discloses a cleaning method of treating a spot or stain on a textile fabric comprising the steps of applying a detergent composition to the spot or stain, placing an absorbent layer to one side of the textile fabric, and applying heat and pressure to the opposing side of the textile fabric so that some or all of the spot or stain is absorbed into the absorbent layer. The detergent composition contains 3–90 wt. % hydrophobic solvent, 5–50 wt. % surfactant, and 5–92 wt. % water. d-Limonene is a preferred solvent.

U.S. Pat. No. 4,304,675 to Corey et al., U.S. Pat. No. 4,566,980 to Smith, and U.S. Pat. No. 4,873,000 to Weller all disclose various solid/dry carpet deodorants or treatments with citrus as a desirable fragrance.

In addition to the above patents, the use of d-limonene in carpet cleaning compositions in addressed in the article, "d-Limonene Bears Fruit," from the November 1998 issue of *Cleanfax* magazine. The article states that d-limonene "is experiencing growing acceptance as the solvent of choice for a number of cleaning applications. It is finding its way into steam cleaning, carpet shampoos, and spotting agents." The article further explains that d-limonene is a popular replacement for previously common solvents in the textile cleaning industry due to its low environmental impact and its fresh natural odor.

Furthermore, it is desirable to create a stable carpet cleaning solution that includes normally incompatible components such as terpene hydrocarbons, polysiloxane derivatives, and sulfo-methacrylic polymers without using excessive amounts of surfactant or co-solvents to achieve stability. Unstable formulations tend to create solids that separate and settle out of solution. A stable formulation maintains a liquid mixture without the formation of solids.

SUMMARY OF INVENTION

In one aspect, a carpet cleaning composition comprises water, a terpene hydrocarbon solvent that also functions as a fragrance, one or more surfactants, an anti-soil component, and an anti-stain component. The terpene hydrocarbon solvent is an organic, low volatility solvent produced from citrus oil extract. The terpene hydrocarbon solvent comprises d-limonene, and the d-limonene concentration is between about 0.1 and 5 wt. %, preferably between about 0.5 and 2.0 wt. %, and most preferably about 0.5 wt. %.

The anti-soil component can be a compound containing polysiloxane derivatives. The anti-soil component can be an acrylate copolymer. The anti-soil component concentration is between about 3 and 7 wt. % and preferably about 5 wt. %.

The anti-stain component can be a compound containing an acrylate resin. The anti-stain component concentration is between about 4 and 10 wt. % and preferably about 8 wt. %.

The one or more surfactants comprises at least one of an anionic and a nonionic surfactant. The one or more surfactants can comprise a linear primary alcohol ethoxylate. The one or more surfactants can further comprise a blend of two alkoxylated lineal alcohols. The one or more surfactants can further comprise an alkyl naphthalene sodium sulfonate. The one or more surfactants concentration is between about 4 and 7 wt. % and preferably about 5.5 wt. %.

The carpet cleaning composition can further comprise a pH adjusting agent to maintain a pH in the carpet cleaning composition between 8.5 and 9.5 and preferably at about 9.0. The pH adjusting agent can be an alkali metal hydroxide. The pH adjusting agent concentration is between about 1 and 6 wt. % and preferably between about 1 and 2 wt. %.

The carpet cleaning composition can further comprise an anti-foam agent. The anti-foam agent concentration is between about 0.1 and 1 wt. %.

The water concentration is between about 70 and 85 wt. %.

In another aspect, a carpet cleaning composition comprises 0.5 to 2.0% by weight a terpene hydrocarbon solvent that also functions as a fragrance, 4.0 to 7.0% by weight one or more surfactants, 3.0 to 5.0% by weight an anti-soil component, 4.0 to 10.0% by weight an anti-stain component, and 70 to 85% by weight water. The terpene hydrocarbon solvent concentration is preferably 0.5% by weight, the one or more surfactants concentration is preferably 5.5% by weight, the anti-soil component concentration is preferably 5.0% by weight, the anti-stain component concentration is preferably 8.0% by weight, and the water concentration is preferably 79.15% by weight.

The carpet cleaning composition can further comprise a pH adjusting agent to maintain a pH in the carpet cleaning composition between 8.5 and 9.5. The carpet cleaning composition can further comprise 0.1 to 1.0% by weight an anti-foam agent. The terpene hydrocarbon solvent is d-limonene.

DETAILED DESCRIPTION

A carpet and fabric composition for a carpet and fabric cleaning solution includes a solvent that functions as a cleaner and also as a fragrance, at least one surfactant, a pH adjusting agent, and, optionally, an anti-foam agent. The cleaning composition can also include one or more protectants, including an anti-stain (also known as stain resist) and/or anti-soil (also known as soil resist) agent. An example of the anti-stain agent is a compound containing acrylate resin, such as PM 1874, manufactured by the 3M Company. Suitable anti-stain agents are disclosed in U.S. Pat. No. 5,948,480, which is incorporated herein by reference. As disclosed in U.S. Pat. No. 5,948,480, suitable stain resists are polymers containing phenolformaldehyde, methacrylic acid, maleic acid, sulfonated fatty acids and blends of the above. In addition, suitable anti-stain agents are disclosed in U.S. Patent Application Publication No. US2003/0060395A1 include sulfonated aromatic polymers, polymers that are derived from at least one or more α- and/or β-substituted acrylic acid monomers, and hydrolyzed copolymers of at least one or more ethylenically unsaturated monomers and maleic anhydride. Also useful as stainblocking polymers are blends of at least two or more of these polymers, reaction products of at least two or more monomers from which these polymers may be derived, reaction products of at least one or more of the monomers from which the polymers may be derived and at least one or more of the polymers, and materials obtained by polymerizing at least one or more monomers in the presence of one or more polymers. An example of the anti-soil or soil resist agent is a compound containing polysiloxane derivatives, such as PM 1870, which is also manufactured by the 3M Company. Suitable anti-soil agents are disclosed in U.S. Pat. Nos. 6,043,209; 5,534,167; and 5,888,290, which are incorporated herein by reference. Other agents may include acrylate copolymers, such as Syntran HX15-18, manufactured by Interpolymer Corporation. Soil resist agents as disclosed in U.S. Pat. No. 6,043,209 includes polymers derived from monomers of acrylic acid, methacrylic acid, methacrylate, methylmethacrylate, ethyl acrylate and maleic acid, as well as copolymers derived from the above monomers and olefin. Soil resist can also include a fluorinated hydrocarbons, including perfluoroalkyl compounds. The U.S. Pat. No. 5,888,290 discloses a composition comprising a sol comprising a colloidal dispersion of substantially discrete, substantially monodisperse in size, polymer-grafted, inorganic microparticles in liquid and at least one fluorochemical. The composition is said to have durable water and oil repellency, durable stain release, and durable dry soil resistance to substrates, including carpets and fabrics.

In the preferred embodiment, the solvent is an organic, low volatility citrus based solvent combined with deionized water. The organic, low volatility citrus solvent is any one of the group generally referred to as terpene hydrocarbons. Preferably, the terpene hydrocarbon is d-limonene, which is one of the two isomeric forms of limonene. d-Limonene is a naturally occurring citrus oil extract and is a desirable hydrophobic solvent because it maintains a stable liquid formulation and is not known to deplete naturally occurring ozone in the upper atmosphere. Furthermore, d-limonene serves as a pleasant fragrance, and therefore, supplemental fragrances are unnecessary. d-Limonene is also a plasticizer, and high concentrations thereof can soften, swell, or otherwise degrade or damage polymeric materials, such as those that compose its container or components of a carpet cleaning machine. To avoid such damage, the concentration of d-limonene in the cleaning composition is low, preferably between 0.1 and 2.5 wt. % and most preferably between 0.5 and 2.0 wt. %. In addition, the deionized water is preferred as a solvent medium for the cleaning composition. The deionized water will prevent the contamination of the cleaning solution from trace minerals in the water. The deionized water serves as a solvent for the cleaning agent and evaporates with little or no residue after delivering cleaning agents to the carpet or upholstery. Optionally, a glycol ether can be included as a solvent. Specifically, propylene glycol methyl ether, or Glycol Ether PM, can be present in the range of 1.0 to 1.5 wt. %.

The surfactant in the cleaning composition stabilizes the terpene hydrocarbon in solution and creates minimum residue that can be vacuumed and removed after the cleaning process. The surfactant can be one or a combination of surfactants, including nonionic and anionic surfactants. Suitable nonionic surfactants include blends of two alkoxylated lineal alcohols, such as Poly Tergent Blend 3-1, which is manufactured by BASF Corporation, a secondary alcohol ethoxylate, such as Tergitol 15-s-40, manufactured by Dow Chemical Company, a primary linear alcohol ethoxylate, such as Tomadol 1-5, or a linear alcohol alkoxylate, such as Nonidet SF-5. Tomadol 1-5 and Nonidet SF-5 are both available from Tomah Products. Tomodol 1-5 is made from C-11 alcohol and ethylene oxide and is especially effective at stabilizing d-limonene in solution. The nonionic surfactants can be present in the range of about 1.0 to 3.0 wt. %. A suitable anionic surfactant is an alkyl naphthalene sodium sulfonate, such as Petro ULF, manufactured by AKZO Nobel. Further, Colamulse SBC, manufactured by Colonial Chemical Company, is an acceptable emulsifier for citrus oils. The anionic surfactant can be present in suitable amounts, for example between about 1.0 and 3.0 wt. %.

The pH adjusting agent adjusts and stabilizes the composition. The pH adjusting agent maintains the pH in the cleaning solution between 8.5 and 9.5, preferably about 9.0. A typical pH adjusting agent is a sulfonated copolymer such as Alcosperse EXP 3779, manufactured by Alco Chemical. Other suitable pH adjusting agents include ethylenediteetramine, commonly known as EDTA; sodium hydroxide, NaOH, in percentages between 10% and 50%; potassium hydroxide, KOH; and phosphates.

The optional anti-foam agent controls the amount of foam in the cleaning solution. An exemplary anti-foam agent is an organofunctional silicone antifoam, such as DSP Anti-Foam, manufactured by Dow Corning Corporation.

SPECIFIC EXAMPLES

Example 1

A cleaning composition was prepared with the following ingredients:

| Ingredient | Primary Function | % Weight |
|---|---|---|
| Deionized Water | Solvent | 79.15 |
| d-Limonene | Solvent | 0.5 |
| PM 1874[1] | Anti-stain agent | 8.0 |
| Syntran HX15-18[2] | Anti-soil agent | 5.0 |
| Petro ULF[3] | Anionic surfactant | 3.0 |
| Poly Tergent Blend 3-1[4] | Nonionic surfactant | 2.0 |
| Tomadol 1-5[5] | Nonionic surfactant | 0.5 |
| NaOH, 50% | pH adjusting agent | 1.78 |
| DSP Anti-Foam[6] | Anti-foam agent | 0.07 |
| pH | | 8.99 |

[1]Compound containing acrylate resin, manufactured by the 3M Company
[2]Acrylic polymer, manufactured by Interpolymer Corporation
[3]Alkyl naphthalene sodium sulfonate, manufactured by AKZO Nobel
[4]Blend of two alkoxylated lineal alcohols, manufactured by BASF Corporation
[5]Linear primary alcohol ethoxylate, manufactured by Tomah Chemical Company
[6]10% active organofunctional silicone antifoam, manufactured by Dow Corning Corporation To evaluate the effectiveness of the cleaning composition, a test was conducted in accordance with a modified version of CSMA DCC-03 performance testing entitled Rug Shampoo. A spectrophotometer measurement was taken on a swatch of new carpet. An artificial soil was applied to the carpet and the soil was distributed and worked into the carpet by means of ceramic ball-milling cylinders inside the test chamber as it rotated. A spectrophotometer measurement was taken on the soiled carpet. An upright extraction cleaning machine utilizing the composition of Example 1 was used to clean the carpet and a final spectrophotometer measurement was taken. Cleaning performance was calculated from the spectrophotometer values. The carpet was satisfactorily cleaned.

Other compositions of the cleaner set forth below were prepared by mixing ingredients as set forth above and tested as above. All performed satisfactorily when sprayed onto a stained carpet or upholstery fabric.

Examples 2–5

| Ingredient (Primary Function) | % Weight Example 2 | % Weight Example 3 | % Weight Example 4 | % Weight Example 5 |
|---|---|---|---|---|
| Deionized Water(Solvent) | 82.93 | 82.93 | 82.93 | 81.93 |
| d-Limonene(Solvent) | 1.0 | 0.5 | 1.0 | 2.0 |
| Glycol Ether PM(Solvent) | 1.0 | 1.5 | 1.0 | — |
| PM 1874 [1](Anti-stain agent) | 4.0 | 4.0 | 4.0 | 4.0 |
| Syntran HX15-18 [2](Anti-soil agent) | 5.0 | 5.0 | 5.0 | 5.0 |
| PM 1870 [7](Anti-soil agent) | 0.5 | 0.5 | 0.5 | 0.5 |
| Petro ULF [3](Anionic surfactant) | 3.0 | 3.0 | 2.5 | 2.5 |
| Colamulse SBC [8](Anionic surfactant) | — | — | 1.0 | 2.0 |
| Poly Tergent Blend 3-1[4] (Nonionic surfactant) | 2.0 | 2.0 | 2.0 | 2.0 |
| Tergitol 15-s-40 [9](Nonionic surfactant) | 0.5 | 0.5 | — | — |
| DSP Anti-Foam [6](Anti-foam agent) | 0.07 | 0.07 | 0.07 | 0.07 |

[1]Compound containing acrylate resin, manufactured by the 3M Company
[2]Acrylic polymer, manufactured by Interpolymer Corporation
[3]Alkyl naphthalene sodium sulfonate, manufactured by AKZO Nobel
[4]Blend of two alkoxylated lineal alcohols, manufactured by BASF Corporation
[6]10% active organofunctional silicone antifoam, manufactured by Dow Corning Corporation
[7]Compound containing polysiloxane derivatives, manufactured by the 3M Company
[8]Emulsifier for citrus oils, manufactured by Colonial Chemical Company
[9]Secondary alcohol ethoxylate, manufactured by Dow Chemical Company

Examples 6 and 7

| Ingredient(Primary Function) | % Weight Example 6 | % Weight Example 7 |
|---|---|---|
| Deionized Water(Solvent) | 76.50 | 77.48 |
| d-Limonene(Solvent) | 0.50 | 0.50 |
| PM 1874[1](Anti-stain agent) | 8.00 | 8.00 |
| Syntran HX15-18[2](Anti-soil agent) | 5.00 | 5.00 |
| Petro ULF[3](Anionic surfactant) | 3.00 | 2.50 |
| Poly Tergent Blend 3-1 [4](Nonionic surfactant) | 2.00 | — |
| Tomadol 1-5[5](Nonionic surfactant) | 0.50 | 1.00 |
| Nonidet SF-5[10](Nonionic surfactant) | — | 1.00 |
| NaOH, 20% (pH adjusting agent) | 4.43 | 4.45 |
| DSP Anti-Foam[6](Anti-foam agent) | 0.07 | 0.07 |
| pH | 9.16 | 9.26 |

[1]Compound containing acrylate resin, manufactured by the 3M Company
[2]Acrylic polymer, manufactured by Interpolymer Corporation
[3]Alkyl naphthalene sodium sulfonate, manufactured by AKZO Nobel
[4]Blend of two alkoxylated lineal alcohols, manufactured by BASF Corporation
[5]Linear primary alcohol ethoxylate, manufactured by Tomah Chemical Company
[6]10% active organofunctional silicone antifoam, manufactured by Dow Corning Corporation
[10]Linear alcohol alkoxylate, manufactured by Tomah Products Examples 8–11

| Ingredient (Primary Function) | % Weight Example 8 | % Weight Example 9 | % Weight Example 10 | % Weight Example 11 |
|---|---|---|---|---|
| Deionized Water(Solvent) | 74.01 | 73.60 | 75.57 | 76.01 |
| d-Limonene(Solvent) | 2.0 | 2.0 | 1.0 | 1.0 |
| PM 1874 [1](Anti-stain agent) | 8.0 | 8.0 | 8.0 | 8.0 |
| Syntran HX15-18 [2](Anti-soil agent) | 5.0 | — | — | 5.0 |
| Petro ULF [3](Anionic surfactant) | 2.5 | 2.5 | 2.5 | 2.5 |
| Colamulse SBC [8](Anionic surfactant) | 2.0 | 2.0 | 1.0 | 1.0 |
| Poly Tergent Blend 3-1 [4](Nonionic surfactant) | 2.0 | 2.0 | 2.0 | 2.0 |
| NaOH, 20% (pH adjusting agent) | 4.42 | 4.83 | 4.86 | 4.42 |
| Alcosperse EXP 3779[11] (pH adjusting agent) | — | 5.0 | 5.0 | — |
| DSP Anti-Foam [6](Anti-foam agent) | 0.07 | 0.07 | 0.07 | 0.07 |
| pH | 8.98 | 9.01 | 9.12 | 9.03 |

[1]Compound containing acrylate resin, manufactured by the 3M Company
[2]Acrylic polymer, manufactured by Interpolymer Corporation
[3]Alkyl naphthalene sodium sulfonate, manufactured by AKZO Nobel
[4]Blend of two alkoxylated lineal alcohols, manufactured by BASF Corporation
[6]10% active organofunctional silicone antifoam, manufactured by Dow Corning Corporation
[8]Emulsifier for citrus oils, manufactured by Colonial Chemical Company
[11]Sulfonated copolymer, manufactured by Alco Chemical The carpet cleaning composition of the present invention is an effective carpet cleaning formulation with affinity for oily based and heavy soils while imparting soil resistant properties to the fibers. Further, the invention provides improved soil and stain-resistance to manufactured carpet and/or fabric after thorough cleaning. Still further, the composition according to the invention has the citrus oil extract that that serves as a fragrance and an organic solvent without the need for additional fragrance components or solvents in the composition.

While the invention has been specifically described in connection with certain specific embodiments thereof, it is to be understood that this is by way of illustration and not of limitation. Reasonable variation and modification are possible within the forgoing disclosure without departing from the spirit of the invention, which is defined in the appended claims.

The invention claimed is:

1. An aqueous carpet cleaning composition comprising:

a terpene hydrocarbon solvent that also functions as a fragrance;

one or more surfactants;

a soil resist component;

a stain resist component that includes at least one compound selected from the group consisting of polymers containing phenol-formaldehyde, methacrylic acid, maleic acid, sulfonated fatty acids, and blends thereof; and acrylate resins;

water in an amount sufficient to form an aqueous solution with the terpene hydrocarbon solvent, the one or more surfactants, the soil resist component, and the stain resist component; wherein the one or more surfactants includes at least one nonionic surfactant in an amount sufficient to stabilize the terpene hydrocarbon solvent in the aqueous solution; and a pH adjusting agent in an amount sufficient to maintain a pH of the aqueous carpet cleaning composition between about 8.5 and 9.5 to stabilize the carpet cleaning composition so that the terpene hydrocarbon solvent, the one or more surfactants, the soil resist component, and the stain resist component remain in solution.

2. An aqueous carpet cleaning composition according to claim 1 wherein the terpene hydrocarbon solvent is an organic, low volatility solvent produced from citrus oil extract.

3. An aqueous carpet cleaning composition according to claim 1 wherein the terpene hydrocarbon solvent comprises d-limonene.

4. An aqueous carpet cleaning composition according to claim 3 wherein the d-limonene concentration is greater than about 0.1 wt. % and less than or equal to about 5 wt. %.

5. An aqueous carpet cleaning composition according to claim 4 wherein the d-limonene concentration is between about 0.5 and 2.0 wt. %.

6. An aqueous carpet cleaning composition according to claim 5 wherein the d-limonene concentration is about 0.5 wt. %.

7. An aqueous carpet cleaning composition according to claim 1 wherein the soil resist component is a compound containing polysiloxane derivatives.

8. An aqueous carpet cleaning composition according to claim 1 wherein the soil resist component is an acrylate copolymer.

9. An aqueous carpet cleaning composition according to claim 1 wherein the soil resist component concentration is between about 3 and 7 wt. %.

10. An aqueous carpet cleaning composition according to claim 9 wherein the soil resist component concentration is about 5 wt. %.

11. An aqueous carpet cleaning composition according to claim 1 wherein the stain resist component is a compound containing an acrylate resin.

12. An aqueous carpet cleaning composition according to claim 1 wherein the stain resist component concentration is between about 4 and 10 wt. %.

13. An aqueous carpet cleaning composition according to claim 12 wherein the stain resist component concentration is about 8 wt. %.

14. An aqueous carpet cleaning composition according to claim 1 wherein the one or more surfactants further comprises at least one anionic surfactant.

15. An aqueous carpet cleaning composition according to claim 14 wherein the at least one nonionic surfactants comprises a linear primary alcohol ethoxylate.

16. An aqueous carpet cleaning composition according to claim 15 wherein the at least one nonionic surfactants further comprises a blend of two alkoxylated linear alcohols.

17. An aqueous carpet cleaning composition according to claim 16 wherein the at least one anionic surfactants comprises an alkyl naphthalene sodium sulfonate.

18. An aqueous carpet cleaning composition according to claim 1 wherein the one or more surfactants concentration is between about 5.5 and 7 wt. %.

19. An aqueous carpet cleaning composition according to claim 18 wherein the one or more surfactants concentration is about 5.5 wt. %.

20. A aqueous carpet cleaning composition according to claim 1 wherein the pH in the carpet cleaning composition is maintained at about 9.0.

21. An aqueous carpet cleaning composition according to claim 1 wherein the pH adjusting agent is an alkali metal hydroxide.

22. An aqueous carpet cleaning composition according to claim 1 wherein the pH adjusting agent concentration is between about 1 and 6 wt %.

23. An aqueous carpet cleaning composition according to claim 22 wherein the pH adjusting agent concentration is between about 1 and 2 wt. %.

24. An aqueous carpet cleaning composition according to claim 1 and further comprising an anti-foam agent.

25. An aqueous carpet cleaning composition according to claim 24 wherein the anti-foam agent concentration is between about 0.01 and 0.10 wt. %.

26. An aqueous carpet cleaning composition according to claim 1 wherein the water concentration is between about 70 and 85 wt. %.

27. An aqueous carpet cleaning composition comprising:

0.5 to 2.0% by weight a terpene hydrocarbon solvent that also functions as a fragrance;

4.0 to 7.0% by weight one or more surfactants comprising at least one nonionic surfactant in an amount sufficient to stabilize the terpene hydrocarbon solvent;

3.0 to 5.0% by weight soil resist component;

4.0 to 10.0% by weight stain resist component that includes at least one compound selected from the croup consisting of polymers containing phenol-formaldehyde, methacrylic acid, maleic acid, sulfonated fatty acids, and blends thereof, and acrylate resins;

70 to 85% by weight water; and a pH adjusting agent to maintain a pH of the aqueous carpet cleaning composition between about 8.5 and 9.5 to stabilize the carpet cleaning composition so that the terpene hydrocarbon solvent, the one or more surfactants, the soil resist component, and the stain resist component remain in solution.

28. An aqueous carpet cleaning composition according to claim 27 and further comprising 0.1 to 0.10% by weight an anti-foam agent.

29. An aqueous carpet cleaning composition according to claim 27 wherein the terpene hydrocarbon solvent is d-limonene.

30. An aqueous carpet cleaning composition according to claim 27 wherein the terpene hydrocarbon solvent concentration is about 0.5% by weight, the one or more surfactants concentration is about 5.5% by weight with the concentration of the at least one nonionic surfactant at about 0.5 wt. %, soil resist component concentration is about 5.0% by weight, and the stain resist component concentration is about 8.0% by weight.

31. An aqueous carpet cleaning composition according to claim 1 wherein the at least one nonionic surfactant concentration is between about 1 and 3 wt. %.

32. An aqueous carpet cleaning composition according to claim 31 wherein the at least one nonionic surfactant concentration is between about 2 and 2.5 wt. %.

33. An aqueous carpet cleaning composition according to claim 14 wherein the at least one anionic surfactant concentration is between about 1 and 4.5 wt. %.

34. An aqueous carpet cleaning composition according to claim 33 wherein the at least one anionic surfactant concentration is about 3 wt. %.

35. An aqueous carpet cleaning composition according to claim 17 wherein the ethoxylated alcohol concentration is about 0.5 wt. %.

36. An aqueous carpet cleaning composition according to claim 35 wherein the blend of two alkoxylated linear alcohols concentration is about 2.0 wt. %.

37. An aqueous carpet cleaning composition according to claim 36 wherein the alkyl naphthalene sodium sulfonate concentration is about 3.0 wt.

38. An aqueous carpet cleaning composition according to claim 1 wherein the at least one nonionic surfactant comprises a linear primary alcohol ethoxylate.

39. An aqueous carpet cleaning composition according to claim 38 wherein the at least one nonionic surfactant further comprises an alkoxylated linear alcohol.

40. An aqueous carpet cleaning composition according to claim 1 wherein the nonionic surfactant comprises an ethoxylated alcohol with a carbon chain with 11 carbon atoms and 5 ethylene oxide groups.

* * * * *